US010095153B2

(12) United States Patent
Kawano et al.

(10) Patent No.: US 10,095,153 B2
(45) Date of Patent: Oct. 9, 2018

(54) OPTICAL SCANNING APPARATUS AND IMAGE FORMING APPARATUS

(71) Applicant: CANON KABUSHIKI KAISHA, Tokyo (JP)

(72) Inventors: Tomoyuki Kawano, Mishima (JP); Junya Azami, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/489,428

(22) Filed: Apr. 17, 2017

(65) Prior Publication Data

US 2017/0299974 A1 Oct. 19, 2017

(30) Foreign Application Priority Data

Apr. 19, 2016 (JP) ..... 2016-083508

(51) Int. Cl.
*G03G 15/00* (2006.01)
*G03G 15/043* (2006.01)
*G03G 21/16* (2006.01)

(52) U.S. Cl.
CPC ..... *G03G 15/043* (2013.01); *G03G 21/1652* (2013.01); *G03G 21/1666* (2013.01); *G03G 15/80* (2013.01)

(58) Field of Classification Search
USPC ..... 399/3, 4, 118, 144, 177, 221
See application file for complete search history.

(56) References Cited

U.S. PATENT DOCUMENTS

| | | | | |
|---|---|---|---|---|
| 5,892,523 | A * | 4/1999 | Tanaka | B41J 3/44 347/109 |
| 6,628,444 | B2 | 9/2003 | Azami | 359/204 |
| 7,508,859 | B2 | 3/2009 | Azami et al. | 372/101 |
| 9,411,157 | B2 | 8/2016 | Ohta et al. | G02B 26/125 |
| 9,551,955 | B2 | 6/2017 | Murotani et al. | G03G 15/043 |
| 9,798,138 | B2 * | 10/2017 | Kudo | G02B 26/125 |
| 2005/0195272 | A1 | 9/2005 | Azami | 347/238 |
| 2011/0235142 | A1 | 9/2011 | Shinya et al. | 359/197.1 |
| 2016/0313554 | A1 | 10/2016 | Ohta et al. | G02B 26/125 |
| 2016/0347083 | A1 * | 12/2016 | Ishidate | B41J 2/471 |

FOREIGN PATENT DOCUMENTS

| | | |
|---|---|---|
| JP | 2003-315716 A | 11/2003 |
| JP | 2011-197614 A | 10/2011 |
| JP | 2014-119540 A | 6/2014 |

* cited by examiner

*Primary Examiner* — Hoan Tran
(74) *Attorney, Agent, or Firm* — Fitzpatrick, Cella, Harper & Scinto

(57) ABSTRACT

An optical scanning apparatus includes a light source for emitting a beam in accordance with image information; a controller substrate for controlling the light source; a deflector for scanningly deflecting the beam; an optical device for directing the deflected beam onto a member-to-be-scanned; a casing supporting the substrate, the deflector and the optical device, wherein the substrate is provided with a projected portion projecting relative to the casing; and a connector for removably connecting a cable for supplying a signal to the light source, the connector being provided on a side of the projected portion where the controller substrate is supported by the casing. The cable is insertable and removable relative to the connector in a direction parallel with a surface of the projected portion provided with the connector.

8 Claims, 9 Drawing Sheets

OPTICAL SCANNING APPARATUS AND IMAGE FORMING APPARATUS

FIELD OF THE INVENTION AND RELATED ART

The present invention relates to an optical apparatus for scanning an object with a beam of light which it emits while modulating the beam according to the information of an image to be formed. It relates to also an electrophotographic image forming apparatus such as a copying machine and a printer, which forms an image on a sheet of recording medium with the use of an optical scanning apparatus.

Generally speaking, an optical scanning device employed by an electrophotographic image forming apparatus such as a laser printer carries out the following operation. It emits multiple beams of laser light from its light source while modulating the beams with image formation signals, deflects the beams of laser light in a manner to scan the peripheral surface of a corresponding photosensitive drum, and focusing each beam of laser light on the peripheral surface of the photosensitive drum, with the use of an f-θ lens, to form an electrostatic latent image, on the peripheral surface of the photosensitive drum. Then, it develops the electrostatic latent image on each photosensitive drum into a visible image (toner image; image formed of toner), transfers the developed image (toner image) onto a sheet of recording medium, sends the sheet to its fixing device, and thermally fixes the toner image on the sheet to the sheet. This is how an image is formed on a sheet of recording medium by an electrophotographic image forming apparatus equipped with an optical scanning device.

In recent years, it has come to be desired that an electrophotographic image forming apparatus, inclusive of the above-described optical scanning device, is structured so that each of various components, units, etc., of the image forming apparatus, can be easily replaced, in particular, in a short length of time.

For example, in the case of an electrophotographic image forming apparatus structured so that its optical scanning device is disposed on the underside of the photosensitive drums as disclosed in Japanese Laid-open Patent Application No. 2014-119540, the optical scanning device is in the deeper end portion of the main assembly of the image forming apparatus as seen from the side from which the optical scanning device is installed into, or uninstalled from, the main assembly. Thus, unless multiple covers and/or multiple electrical component boards are removed from the main assembly, the optical scanning device in the main assembly cannot be replaced. That is, it takes a large number of steps to replace the optical scanning device, and therefore, it takes a substantial length of time to replace the optical scanning device.

From the standpoint of reducing an electrophotographic image forming apparatus in the number of steps it takes to replace the optical scanning device in the main assembly of apparatus, it is desired that the image forming apparatus is structured so that it is only the external cover with which a specific lateral wall of the main assembly of the image forming apparatus is provided, and the structural components of the main assembly, which can be moved out of the opening exposed by the removal of the lateral wall, that have to be removed to replace the optical scanning device in the main assembly. In the case of an electrophotographic image forming apparatus such as the one disclosed in Japanese Laid-open Patent Application No. 2014-119540, it is rare that structural components such as electrical component board, a driving system, etc., are disposed in the area of the main assembly of the image forming apparatus (area in which conveyance roller, etc., are not between optical scanning device and cover), which is directly covered with the specific cover. As long as an electrophotographic image forming apparatus is structured so that its optical scanning device in the main assembly of the apparatus can be replaced by removing only the specific cover of the apparatus, the length of time it takes for the optical scanning device in the image forming apparatus to be replaced is significantly shorter than the length of time it takes for a conventionally optical scanning device in a conventionally structured image forming apparatus to be replaced.

However, the conventional art described above suffers from the following issue.

An optical scanning device such as the above-described one is provided with a laser substrate to which the above-mentioned light source is attached. A laser chip is provided with a connector to which a FFC (Flexible Flat Cable) for controlling the laser is connected. Thus, in order to replace the optical scanning device in the main assembly of the image forming apparatus, the FFC has to be disconnected from the connecter of the laser chip of the optical scanning device in the main assembly, and then, it has to be connected to the connector of the laser chip of a replacement optical scanning device.

However, in order to disconnect the FFC from the connector, or connect the FFC to the connector, a certain amount of space is necessary between the frame (structural member) of the image forming apparatus and the optical scanning device in the apparatus. If there is no space between the frame and optical scanning device, it is impossible for an operator to place his or her hand on the connector, making it difficult to disconnect or connect the FFC.

It is possible to disconnect the FFC from the connector of the optical scanning device to be replaced, and connect the FFC to a replacement optical scanning device before placing the replacement optical scanning device in the main assembly of the image forming apparatus. However, this method requires that the main assembly of an electrophotographic image forming apparatus is provided with a long FFC, being therefore likely to create a new problem that it increases the image forming apparatus in cost and/or an image forming apparatus (optical scanning device) becomes more susceptible to noise. Thus, this method is not desirable.

In a case where the FFC connector with which the main assembly of an electrophotographic image forming apparatus is provided is shaped (right angled) so that the FFC is to be plugged into the connector in the direction which is parallel to the principal surfaces of the laser chip, it is often easier for an operator to reach the connector by his or her hand than in a case where the connector is of the so-called straight type, that is, it is shaped so that the FFC is to be plugged into the connector in the direction perpendicular to the principal surfaces of the laser chip. However, if the laser chip is provided with a connector of the so-called right angle type, it is possible that the line of sight between an operator and the portion (conductive portion) of the FFC, which comes into contact with the connector, will be blocked by the frame of the image forming apparatus and the FFC itself. If the line of sight is blocked, it is impossible for the operator to check whether or not the FFC is plugged askew, making it possible for the FFC to be erroneously connected, which in turn makes it possible for the laser chip and/or light source (laser element) to be damaged.

It is also possible to provide the FFC with a projection, and the connector with a groove into which the projection fits, in order to prevent the FFC to be plugged askew into the connector. This method, which definitely can prevent the FFC from being plugged askew into the connector, makes it impossible for an operator to see the joint between the FFC and connector. Therefore, this method makes it difficult for the operator to fit the protrusion into the groove, reducing therefore, the image forming apparatus in the efficiency with which the optical scanning device in the main assembly of the image forming apparatus can be replaced.

Moreover, it is possible to provide the main assembly of an electrophotographic image forming apparatus with a junction board into which the FFC is plugged, and which is different from the connector with which the laser chip is provided. This junction board is placed on a portion of the main assembly of the image forming apparatus, which can be easily accessed by simply moving a part of one of the external walls of the main assembly. This method definitely makes it easier to replace the optical scanning device in the main assembly. However, it increases the image forming apparatus in cost, and therefore, it not desirable.

SUMMARY OF THE INVENTION

Thus, the primary object of the present invention is to realize a structural arrangement for a combination of an electrophotographic image forming apparatus and its optical scanning device, which can make it easier for an operator to replace the optical scanning device in the main assembly of the apparatus, and also, can reduce the combination in the length of time necessary to replace the optical scanning device, than any conventional structural arrangement for the combination.

According to an aspect of the present invention, there is provided an optical scanning apparatus comprising a light source configured to emit a beam in accordance with image information; a controller substrate configured to control said light source; a deflector configured to scanningly deflect the beam emitted by said light source; optical system configured to direct the beam deflected by said deflector onto a member-to-be-scanned; a casing supporting said controller substrate, said deflector and said optical system, wherein said controller substrate is provided with a projected portion projecting relative to said casing; and a connector configured to removably connect a cable for supplying a signal to said light source, said connector being provided on a side of said projected portion where said controller substrate is supported by said casing, wherein said cable is insertable and removable relative to said connector in a direction parallel with a surface of said projected portion provided with said connector.

Further features of the present invention will become apparent from the following description of exemplary embodiments with reference to the attached drawings.

DESCRIPTION OF THE EMBODIMENTS

Hereinafter, the present invention is described in detail with reference to a few of the preferred embodiments of the present invention. However, the measurements, materials, and shapes of the structural components of the combination of the image forming apparatus, and their positional relationship, in the following embodiments, are not intended to limit the present invention in scope unless specifically noted. That is, the present invention is to be modified as necessary according to the structure of an apparatus to which it is applied, and various conditions under which the apparatus is to be used.

Embodiment 1

Referring to FIGS. 1-9, the image forming apparatus equipped with an optical scanning device in this embodiment is concretely described about its structure.

Figure 1:
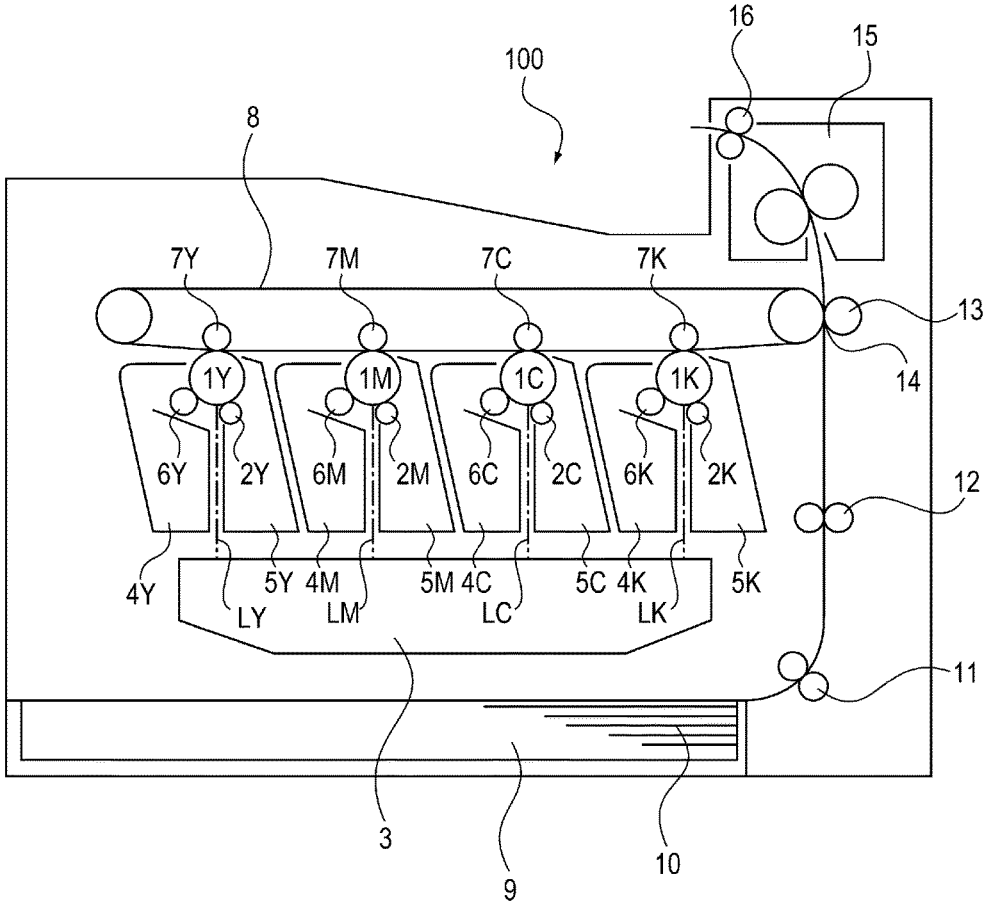
FIG. 1 is a schematic sectional view of the image forming apparatus 100 in the first embodiment of the present invention.

To begin with, referring to FIG. 1, the image forming apparatus equipped with an optical scanning device is described about its overall structure. FIG. 1 is a sectional view of the image forming apparatus in this embodiment. It is for showing the structure of the apparatus.

The image forming apparatus 100 in FIG. 1 is an electrophotographic color image forming apparatus, which is provided with yellow, magenta, cyan, and black toners. It forms a toner image on a sheet 10 of recording medium.

Referring again to FIG. 1, the photosensitive drums 1Y, 1M, 1C and 1K (members to be scanned) are image bearing members. Their peripheral surface is uniformly charged by charge rollers 2Y, 2M, 2C and 2K, respectively, which are charging means. To the uniformly charge portion of the peripheral surface of the photosensitive drum 1Y (1M, 1C and 1K), a beam LY (LM, LC and LK) of laser light is projected. The beams LY, LM, LC and LK of laser light are emitted from an optical scanning device 3, which is an exposing means, while being modulated according to the data of the image to be formed, which are inputted from the image data inputting portion. Thus, an electrostatic latent image is effected on the peripheral surface of each photosensitive drum 1. In this image forming apparatus 100, the optical scanning device 3 is disposed below the combination of the photosensitive drums 1Y, 1M, 1C and 1K.

The electrostatic latent image formed on the photosensitive drum 1Y (1M, 1C and 1K) is supplied with yellow (magenta, cyan and black) toner by the development roller 6Y (6M, 6C and 6K) in a developing device 4Y (4M, 4C and 4K) which is a developing means. Thus, a yellow (magenta, cyan and black) toner image, that is, a visible image formed of yellow (magenta, cyan and black) toner is formed on the photosensitive drum 1Y (1M, 1C and 1K).

The image forming apparatus 100 is provided with an intermediary transfer belt 8, which is suspended and tensioned in the image forming apparatus 100 in such a manner that the intermediary transfer belt 8 opposes each of the photosensitive drums 1Y, 1M, 1C and 1K. The yellow, magenta, cyan and black toner images formed on the photosensitive drums 1Y, 1M, 1C and 1K, respectively, are sequentially transferred (primary transferred) onto the outward surface of the intermediary transfer belt 8. More concretely, the four toner images, different in color, are transferred (primary transfer) by the application of the primary transfer bias voltage to primary transfer rollers 7Y, 7M, 7C and 7K, which are disposed as the primary transferring means on the inward side of the loop which the intermediary transfer belt 8 forms.

The image forming apparatus 100 is provided with a recording medium feeder cassette 9, in which multiple sheets 10 of recording medium are stored in layers. The sheets 10 are fed one by one into the main assembly of the apparatus 100 by a pair of feeding-conveying rollers 11, and then, each sheet 10 is conveyed further in the main assembly by a pair of sheet conveyance rollers 12.

Thereafter, each sheet 10 of recording medium is conveyed, with a preset timing, to the secondary transferring portion 14, which is the nip formed between the intermediary transfer belt 8, and a secondary transfer roller 13 which is the secondary transferring means. To the secondary transfer roller 13, the secondary transfer bias voltage is applied. Thus, while the sheet 10 is conveyed through the secondary transferring portion 14, the toner images on the outward surface of the intermediary transfer belt 8 are transferred onto the sheet 10.

Then, the sheet 10 of recording medium is sent to a fixing device 15, which is a fixing means, by a combination of the secondary transfer roller 13 of the secondary transferring portion 14, and the intermediary transfer belt 8, while remaining pinched between the roller 13 and intermediary transfer belt 8. While the sheet 10 is conveyed through the fixing device 15, the sheet 10 is subjected to heat and pressure by the fixing device 15, whereby the toner images on the sheet 10 become fixed to the sheet 10. Thereafter, the sheet 10 is conveyed further by a pair of discharge rollers 16.

Figure 2:
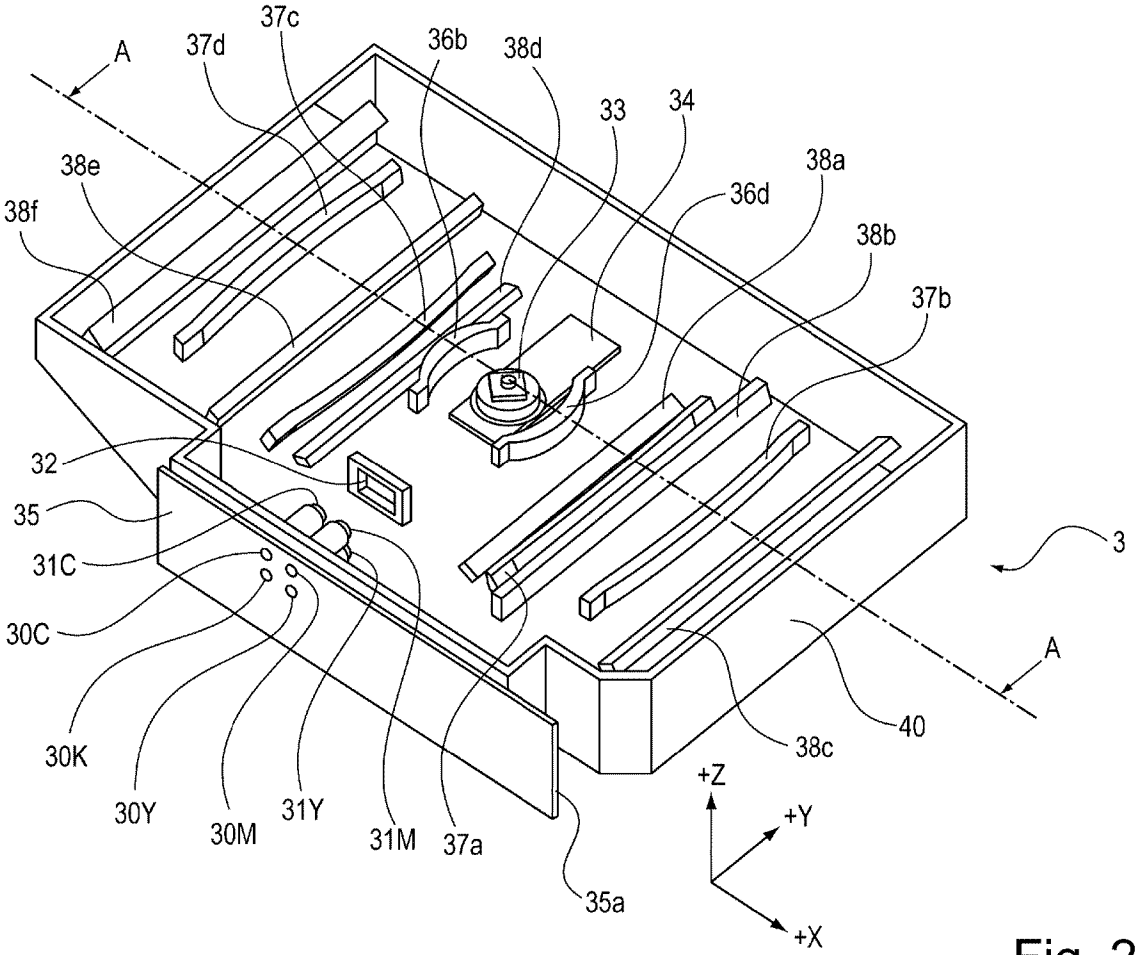
FIG. 2 is a schematic perspective view of the optical scanning device 3 in the first embodiment.
Figure 3:
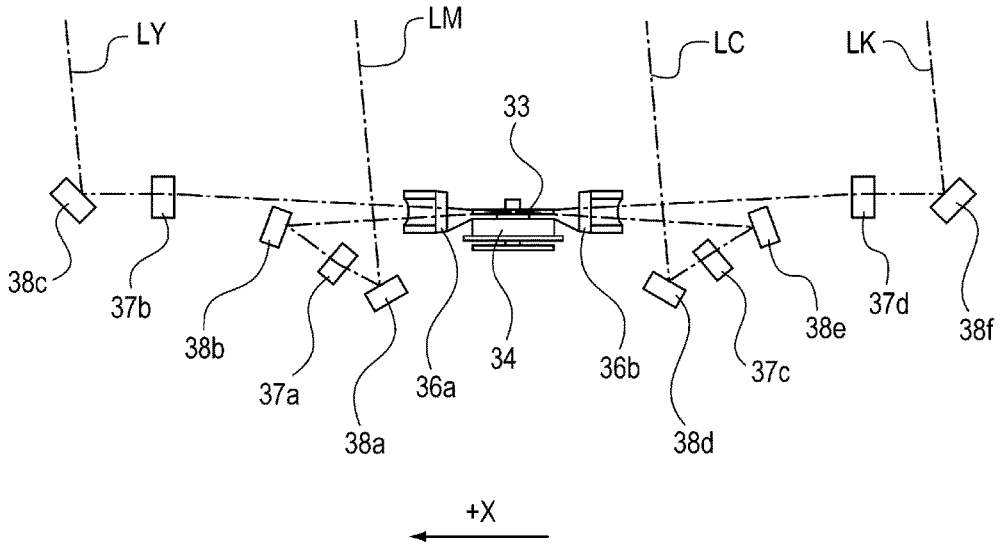
FIG. 3 is a sectional view of the optical scanning system in the first embodiment.

Next, referring to FIGS. 2 and 3, the abovementioned optical scanning device 3 is described about its overall structure. FIG. 2 is a perspective view of the optical scanning device 3 in this embodiment. FIG. 3 is for describing the optical scanning system in this embodiment. It is a sectional view of the optical scanning device 3 at a vertical plane A-A in FIG. 2.

The optical scanning device 3 is equipped with semiconductor laser 30Y, 30M, 30C and 30K, and a laser driving circuit board 35. The semiconductor lasers 30 are light sources which emit a beam of laser light. The laser driving circuit board 35 is a control circuit board for controlling the semiconductor lasers. Further, the optical scanning device 3 is equipped with a rotational polygonal mirror 33 and an optical means. The rotational polygonal mirror 33 is a means for deflecting the beam of laser light emitted by the semiconductor laser in such a manner that as the beam is deflected by the polygonal mirror 33, the beam oscillates in a manner to scan the peripheral surface of the photosensitive drum 1. The optical means is made up of a combination of lenses and mirrors, which guides the beam of laser light to the photosensitive drum 1 (member to be scanned) as the beam of laser light is deflected by the rotational polygonal mirror 33. The laser driving circuit board 35, rotational polygonal mirror 33, and optical means are supported by an optical box 40, which is a part of the optical scanning device 3. The optical scanning device 3 and image forming apparatus 100 are structured so that the former can be inserted into, or extracted from, the latter. The direction in which the optical scanning device 3 is inserted into the image forming apparatus 100 is the left-to-right direction of the image forming apparatus 100 as the apparatus 100 is seen from the front side of FIG. 1. It is opposite (−X) from the direction indicated by a referential mark +X in FIG. 2. As for the direction in which the optical scanning device 3 is moved out of the image forming apparatus 100, it is the right-to-left direction of the image forming apparatus 100 as the apparatus 100 is seen from the front side of FIG. 1.

The semiconductor lasers 30Y, 30M, 30C and 30K are driven by the laser driving circuit board 35 while being controlled by the laser driving circuit board 35. As divergent laser light is emitted by the semiconductor lasers 30Y, 30M, 30C and 30K, it is turned into a parallel beam of laser light by collimator lenses LY, LM, LC or LK (unshown), and is made to transmit through a cylindrical lens 32. As the beam transmits through the cylindrical lens 32, it is made to converge (focus) only in the secondary scan direction. Thus, the beam forms a straight line on the reflective surface of the rotational polygonal mirror 33. The portions of the optical scanning device 3, which were described in the foregoing, make up the laser beam entry portion of the optical system of the optical scanning device 3.

The rotational polygonal mirror 33 changes the direction in which it deflects the beams LY, LM, LC and LK of laser light by being rotationally driven by a scanner motor 34. After being deflected by the rotational polygonal mirror 33, the beam LY of laser light transmits through the first scanning lens 36*a*, transmits through the second scanning lens 37*b*, is deflected by a mirror 38*c*, and forms a light spot on the peripheral surface of the photosensitive drum 1Y. As for the beam LM of laser light, after being deflected (changed in direction) by the rotational polygon mirror 33, it is deflected by the mirror 38*b*, it transmits through the first scanning lens 37*a*, is deflected by the mirror 38*a*, and forms a light spot on the peripheral surface of the photosensitive drum 1M. Assuming here that the direction in which the beams LY and LM of laser light are deflected by the rotational polygonal mirror 33 is the direction indicated by the arrow mark +X, the beams LC and LK of laser light are deflected in the direction indicated by the arrow mark −X (opposite direction from +X) (symmetrical scanning system). That is, the beam LC of laser light is deflected by a mirror 38*e*, transmits through the second scanning lens 37*c*, is deflected by the mirror 38*d*, and forms a light spot on the peripheral surface of the photosensitive drum 1C, whereas the beam LK of laser light transmits through a scanning lens 37*d*, is deflected by a mirror 38*f*, and forms a light spot on the peripheral surface of the photosensitive drum 1K. These portions of the optical scanning device 3 make up the optical scanning system of the optical scanning device 3.

An optical scanning system such as the above-described one forms an image on a sheet of recording medium by guiding the beams of laser light emitted by a light source (laser) in a manner to scan the peripheral surface of an image bearing member (photosensitive drum 1, for example). More concretely, as the beams LY, LM, LC and LK of laser light are projected upon the rotational polygonal mirror 33 which is being rotated, the optical scanning device 3 is continuously changed in the angle at which the beams LY, LM, LC and LK of laser light are deflected by the rotational polygonal mirror 33. Thus, the spots formed on each of the photosensitive drums 1Y, 1M, 1C and 1K by the focusing of the beams of laser light on the peripheral surface of each photosensitive drum 1 moves on the peripheral surface of the photosensitive drum 1 in a manner to scan (primary scan) the peripheral surface of the photosensitive drum 1. On the other hand, the rotation of the photosensitive drums 1Y, 1M, 1C and 1K causes the laser light spots on the peripheral surface of the photosensitive drums 1 to move relative to the peripheral surface of the photosensitive drum 1 in the direction perpendicular to the rotational axis of the photosensitive drum 1 in a manner to scan (secondary scan) the peripheral surface of the photosensitive drum 1. Consequently, an electrostatic latent image, which reflects the information of the image to be formed, is effected on the peripheral surface of the photosensitive drum 1. The laser beam entry portion of the optical scanning device, and the multiple optical scanning systems, are precisely fitted in the optical box 40, making up thereby parts of the optical scanning device 3.

By the way, the optical scanning device 3 in this embodiment requires only a single laser driving circuit board 35. It is a symmetrical system. Therefore, it is desired that the laser driving circuit board 35 is positioned roughly in the center of the optical scanning device 3, with reference to FIG. 3, which is a sectional view of the optical scanning system.

Figure 4:
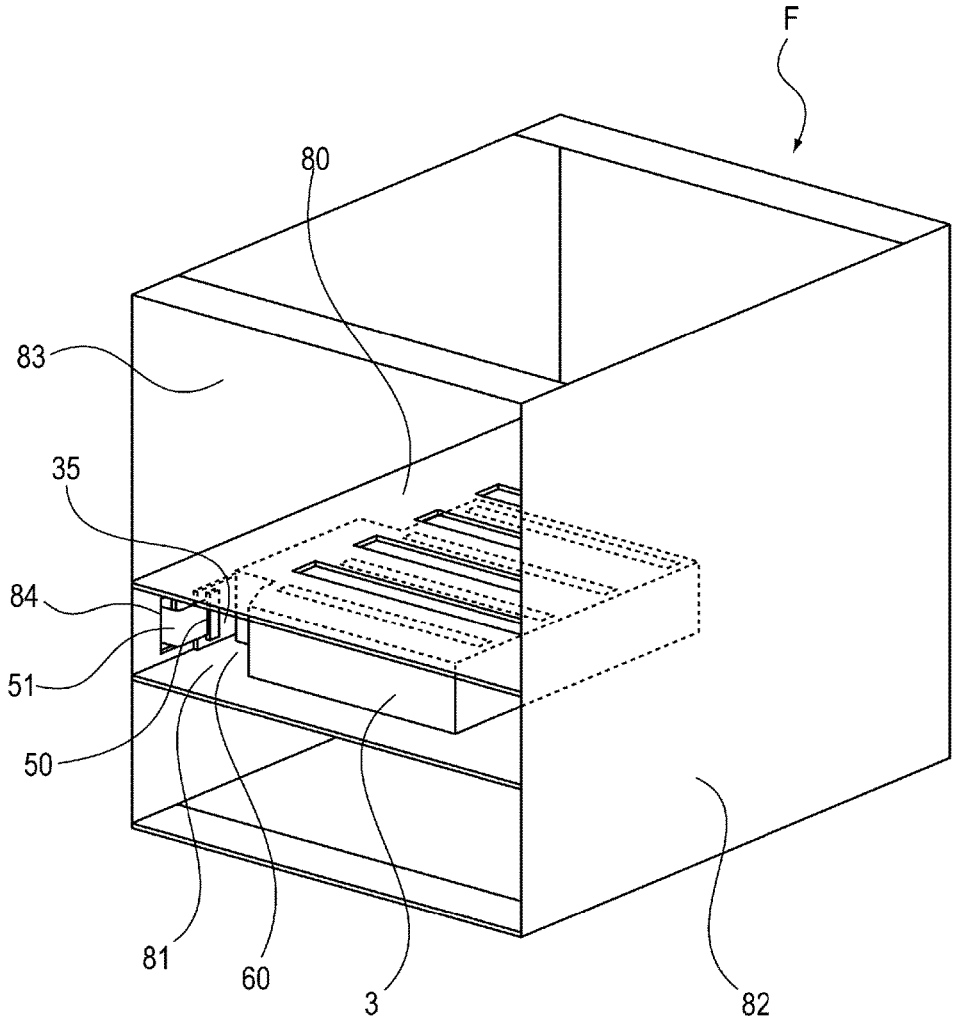
FIG. 4 is a partially phantom schematic perspective view of the image forming apparatus 100 in the first embodiment after the proper installation of the optical scanning device 3 into the main assembly of the image forming apparatus 100.

Next, referring to FIG. 4, the internal portion of the image forming apparatus 100, to which optical scanning device 3 is disposed in this embodiment is described. FIG. 4 is a schematic perspective view of the frame of the image forming apparatus 100. By the way, it is due to descriptive discretion that some components, some units, some holes with which the frame is provided, etc., are not shown in FIG. 4.

Referring to FIG. 4, the image forming apparatus 100 has a frame F as a structural component. The frame F is made up of a front plate 82, a rear plate 83, a top stay 80, a bottom stay 81, and an unshown right plate. The image forming apparatus 100 and optical scanning device 3 are structured so that the latter can be installed into, or extracted from, the position, shown in FIG. 4, in the space surrounded by the front plate 82, rear plate 83, top stay 80, bottom stay 81, and unnumbered right plate. Further, the image forming apparatus 100 is provided with unshown driver gears, electrical circuit boards, a controller which generates image formation signals, etc., which are attached to the rear plate 83. The controller and laser driving circuit board 35 are in electrical connection to each other through the FFC 51, enabling the optical scanning device 3 to be supplied with electric power and image formation signals.

Because of the positional relationship between the laser driving circuit board 35 of the optical scanning device 3, and also, in order to minimize the main assembly of the image forming apparatus 100 in the length of the FFC 51, the controller of the image forming apparatus 100, the main assembly of the image forming apparatus 100, and the optical scanning device 3, are structured so that the FFC 51 is put through a hole 84, with which the rear plate 83 of the main assembly is provided.

Figure 5:
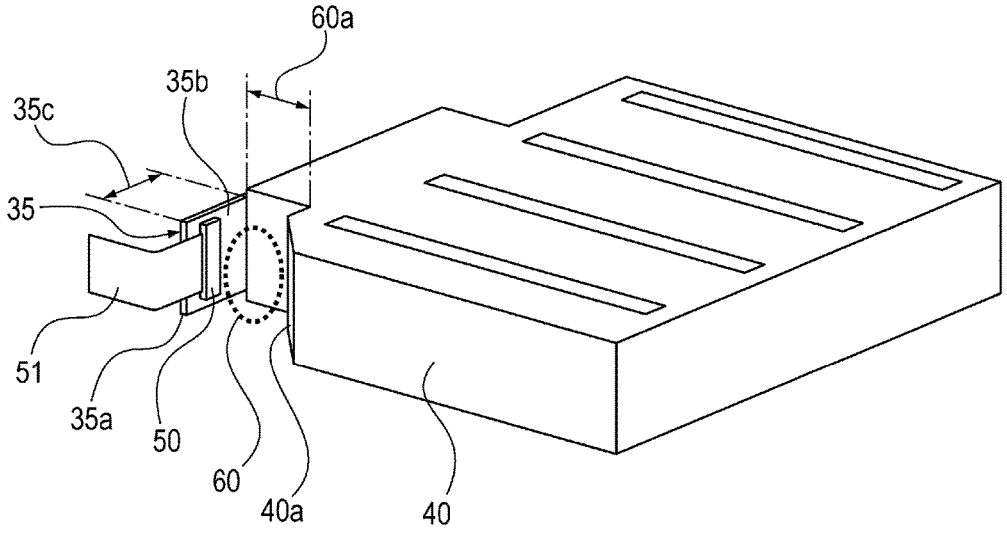
FIG. 5 is a perspective view of the optical scanning device 3 in the first embodiment. It is for showing the characteristic structural features of the device 3.

Next, referring to FIG. 5, the optical scanning device 3 in this embodiment is described about its characteristic structural features. FIG. 5 is an enlarged perspective view of the laser driving circuit board 35 and its adjacencies.

The FFC 51 is a cable through which such signals that reflect image formation data and the like for driving the laser driving circuit board 35 is put. It is connected to the laser driving circuit board 35 with the use of the connector 50 with which the laser driving circuit board 35 is provided. The laser driving circuit board 35 is of the so-called two-sided type. It is provided with a protrusive portion 35*a* which is protrusive toward the optical box 40, that is, in the upstream direction in terms of the direction (opposite direction from direction indicated by arrow mark +X in FIG. 2) in which the optical scanning device 3 is inserted into the image forming apparatus 100.

The connector 50 is attached to the surface 35*b* of the laser driving circuit board 35, by which the laser driving circuit board 35 is attached to the optical box 40. The connector 50 is of the so-called right-angle type. That is, it is configured so that the FFC 51 is to be inserted into the connector 50 in the direction parallel to the principal surface 35*b* (surface of protrusive portion 35*a*, to which connector 50 is attached). The connector 50 is attached to the farthest end portion of the protrusive portion 35*a* of the laser driving circuit board 35 from the optical box 40. In terms of the direction (opposite direction from direction indicated by arrow mark +X in FIG. 2) in which the optical scanning device 3 is inserted into the image forming apparatus 100, the connector 50 is attached to the upstream end portion of the protrusive portion 35*a* of the laser driving circuit board 35.

Further, an empty space 60 is provided between the protrusive portion 35*a* and the surface of the optical box 40, which faces the surface 35*b* of the protrusive portion 35*a*, to which the connector 50 is attached. By the way, the direction in which the FFC 51 is inserted into the connector 50 is the same as the direction in which the optical scanning device 3 is inserted into the image forming apparatus 100.

Figure 6:
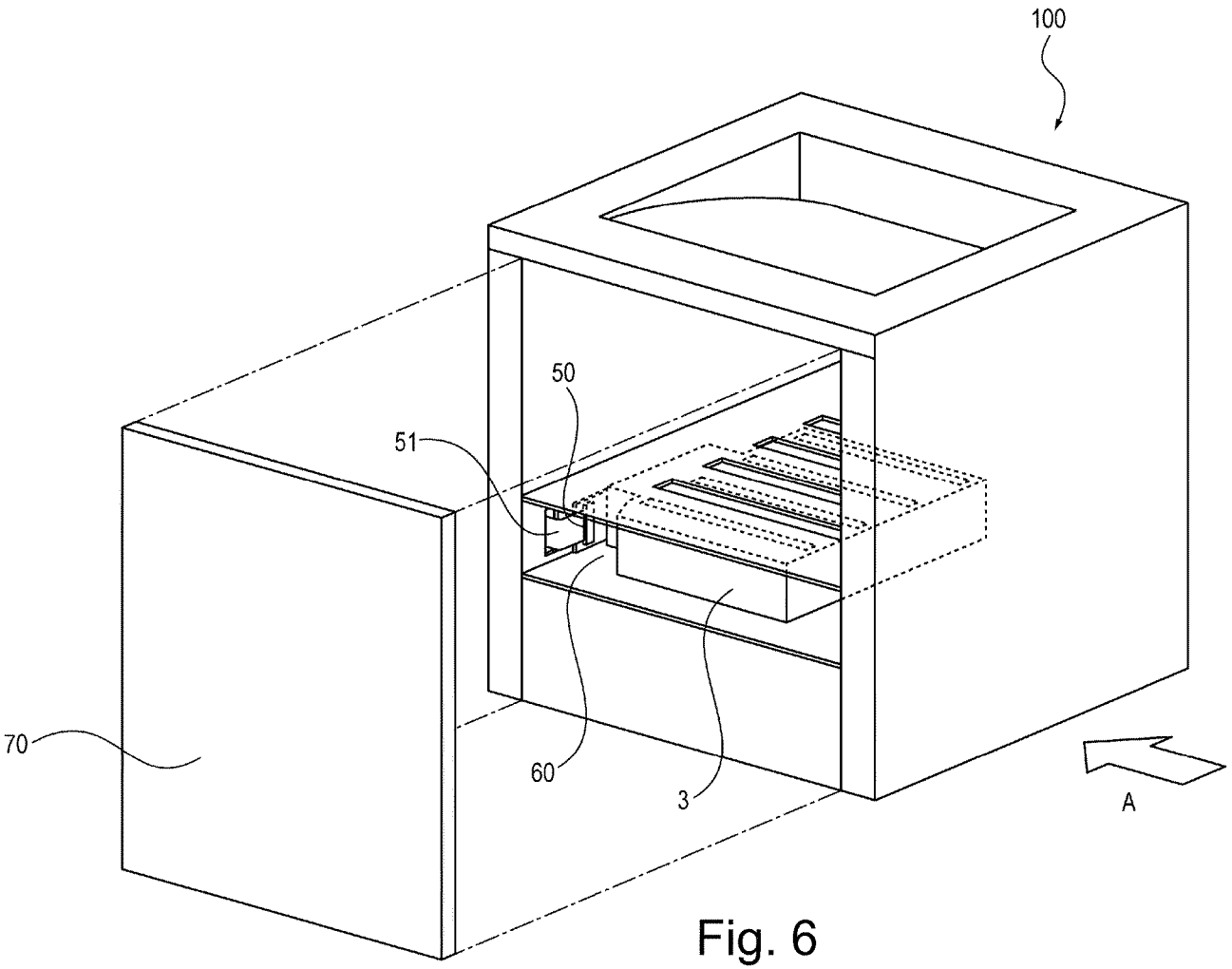
FIG. 6 is a partially phantom schematic view of the image forming apparatus 100 in the first embodiment, after the removal of the external cover 70 of the apparatus 100.

At this time, referring to FIG. 6, the procedure through which the optical scanning device 3 in this embodiment is taken out of the image forming apparatus 100 in this embodiment, and then, its replacement is inserted into the image forming apparatus 100, is described.

FIG. 6 is a schematic perspective view of the image forming apparatus 100 after the removal of the left wall (left plate 70 of the casing of the image forming apparatus 100 as seen from front side of apparatus 100). By the way, FIG. 6 does not show the structural components, units, etc., of the image forming apparatus 100, which have no relation to the description of this embodiment.

In this embodiment, the specific wall (left wall as seen from front side of apparatus 100) of the casing of the image forming apparatus 100 is provided with the left cover 70, which is a part of the left wall of the casing. The image forming apparatus 100 is structured so that it is only the left cover 70 that has to be removed for an operator to access the optical scanning device 3 disposed in the specific position in the frame F. Thus, after the removal the left cover 70, the FFC 51 can be easily pulled out of the connector 50 of the optical scanning device 3. After the FFC 51 is pulled out of the connector 50, the optical scanning device 3 can be moved out of the image forming apparatus 100 through the opening of the left wall.

Figure 7:
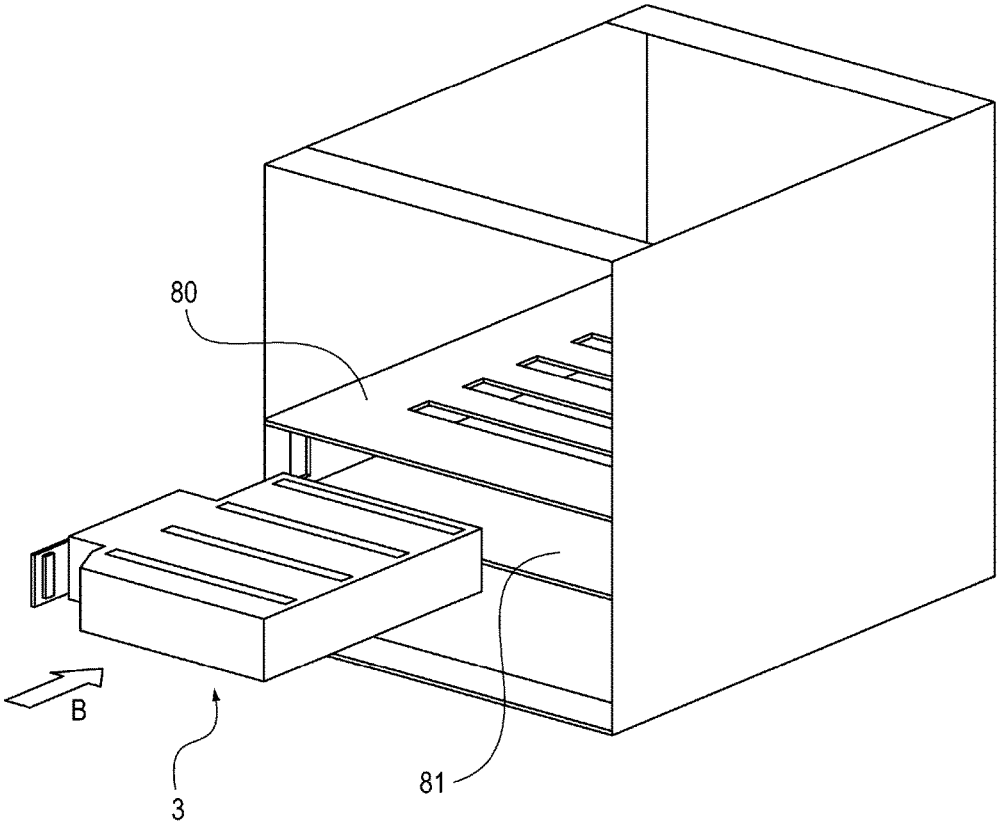
FIG. 7 is a schematic perspective view of the image forming apparatus 100 in the first embodiment, when its optical scanning device 3 is ready to be installed into the main assembly of the apparatus 100.

Next, referring to FIG. 7, the procedure through which a replacement optical scanning device 3 is installed into the image forming apparatus 100 is described again.

Referring to FIG. 7, first, an operator is to insert the replacement optical scanning device 3 into the space between the top and bottom stays 80 and 81 of the frame F, in the direction indicated by an arrow mark B, and place the optical scanning device 3 in the preset position. Then, the operator is to insert the FFC 51 into the connector 50. After the placement of the optical scanning device 3 in the preset position in the image forming apparatus 100, the combination of the optical scanning device 3 and image forming apparatus 100 appears as shown in FIG. 4. As described above, the image forming apparatus 100 and optical scanning device 3 are structured so that after the installation of the latter into the former, the space 60 is provided between the surface 35*b* of the protrusive portion 35*a*, to which the connector 50 is attached, and the surface of the optical box 40 of the scanning device 3, which faces the protrusive portion 35. That is, the image forming apparatus 100 and optical scanning device 3 are structured to insure that after the insertion of the latter into the former, there is such a space that is large enough to enable an operator to easily connect the FFC 51 to the connector 50. Therefore, the FFC 51 can be easily and quickly connected to the connector 50. Further, because of the provision of the space 60, an operator can visually confirm whether or not the FFC 51 was successfully pulled out of the connector 50 of the old optical scanning device 3 in the image forming apparatus 100, or successfully inserted into the replacement optical scanning device 3. Therefore, it is possible to prevent an operator from making operational mistakes when the operator is replacing the optical scanning device 3 in the image forming apparatus 100. Further, the provision of the space 60 makes it unnecessary to provide the image forming apparatus 100 with additional components, such as the intermediary junction board, for the cable connection. That is, this embodiment makes it possible to provide a combination of an electrophotographic image forming apparatus and an optical scanning device, which is far simpler in structure, being therefore far less in cost than any conventional combination of an electrophotographic image forming apparatus and an optical scanning device.

Figure 8:
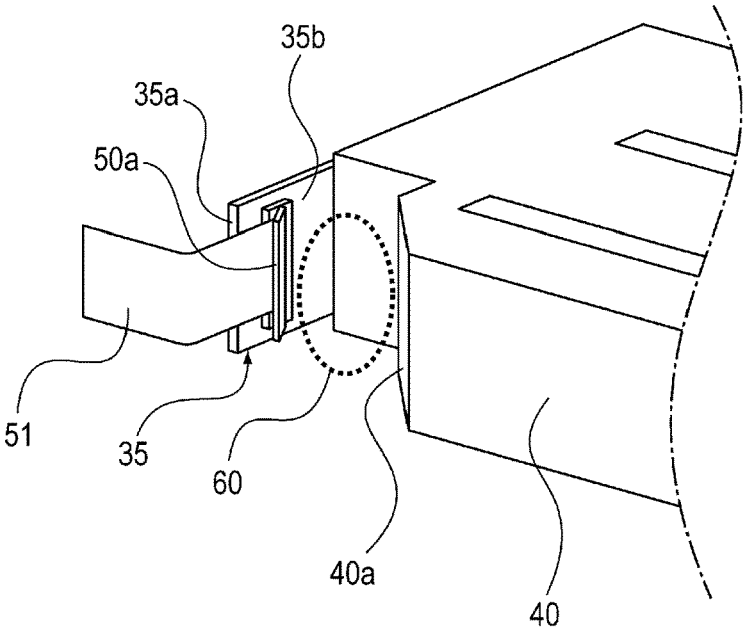
FIG. 8 is a perspective view of a combination of the FFC of the main assembly of the electrophotographic image forming apparatus 100, and the FFC connector of the optical scanning device, and its adjacencies, in the first embodiment, when the FFC 51 is being connected to the FFC connector of the optical scanning device.
Figure 9:
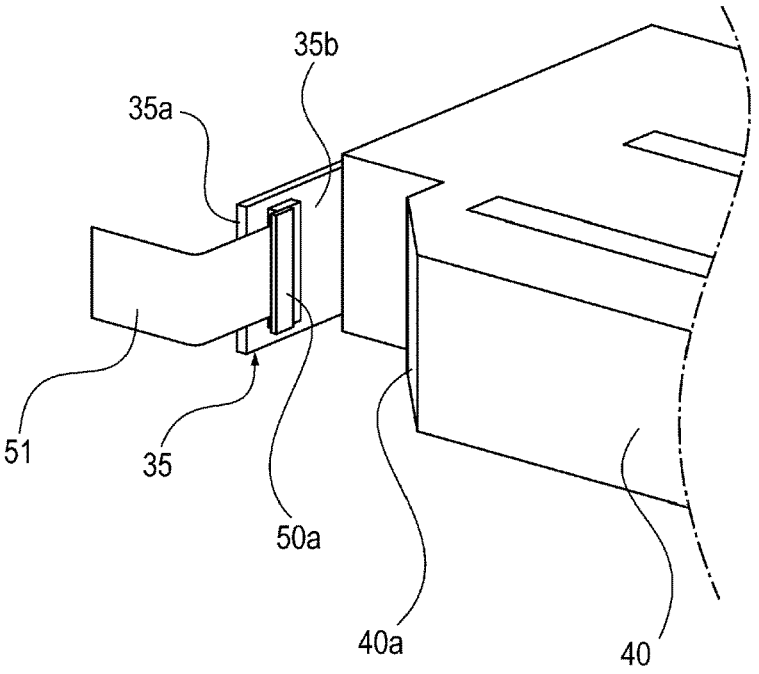
FIG. 9 is a perspective view of a combination of the FFC of the main assembly of the image forming apparatus, and the FFC connector of the optical scanning device, and its adjacencies, in the first embodiment, right after the FFC 51 was connected to the FFC connector of the optical scanning device.

By the way, it is not mandatory that the connector 50 is structured so that the FFC 51 is to be simply inserted into the connector 50. For example, the connector 50 may be provided with a cable locking portion 50*a* as shown in FIG. 8. In such a case, the FFC 51 is to be inserted into the connector 50, with the cable locking portion 50*a* of the connector 50 being set in its upright (unlocked) position, and then, the locking portion 50*a* is to be laid down as shown in FIG. 9 to lock the FFC 51 to the connector 50 after the insertion of the FFC into the connector 50.

In this embodiment, the distance 35*c* by which the protrusive portion 35*a* protrudes from the end of the optical box 40 is no less than 15 mm, and the dimension 60*a* of the space 60 (distance between supportive surface of protrusive portion 35*a* and opposing surface of optical box 40) is no less than 20 mm. Further, referring to FIG. 5, the dimension of the protrusive portion 35*a* in terms of the direction in which it is protrusive is roughly 15 mm, and the dimension of the space 60 in terms of the direction perpendicular to the direction in which the FFC 51 is connected to, or disconnected from, the connector 50 is roughly 20 mm. With the space 60 being as large as described above, the space can accommodate a finger of an adult of the average size. That is, in this embodiment, the optical scanning device 3 is provided with the protrusive portion 35*a*. Further, the combination of the image forming apparatus 100 and optical scanning device 3 is structured so that after the installation of the latter into the former, the FFC 51 can be easily inserted into the connector 50, even though the optical scanning device 3 is inserted into the narrow space between the top and bottom stays 80 and 81. In addition, this structural arrangement makes it easy for an operator to visually check whether or not the FFC 51 was properly inserted, from outside the frame F. Moreover, the corner of the optical box 40, which is on the opposite side of the space 60 from the outward edge of the protrusive portion 35*a*, may be chamfered to provide the optical box 40 with a slanted surface 40*a*, to enhance the effects of this embodiment.

According to this embodiment of the present invention, all that is necessary to access the optical scanning device 3 in the main assembly of the image forming apparatus 100 to replace the optical scanning device 3 is to remove the cover 70 with which the specific wall of the casing of the image forming apparatus 100 is provided. Further, the image forming apparatus 100 and optical scanning device 3 are structured so that as the optical scanning device 3 is inserted into the image forming apparatus 100, the space which is large enough for an operator to connect the FFC 51 to the connector 50, or disconnect the FFC 51 from the connector 50 is provided. Thus, this embodiment makes it easier for an operator to replace the optical scanning device 3 in the image forming apparatus 100, and also, shorter the length of time it takes for an operator to replace the optical scanning device 3 than any conventional structural arrangement for a combination of an electrophotographic image forming apparatus and its optical scanning device.

Further, this embodiment makes it possible for an operator to visually confirm the state of connection between the FFC 51 and connector 50. Therefore, it can prevent the occurrence of such an operational error that the FFC 51 is inserted askew. That is, it ensures that the FFC 51 is properly inserted into, or removed from the connector 50. Further, the provision of the above-described space eliminates the need for additional components such as a junction board for the connection of the FFC 51. Thus, this embodiment can provide a combination of an electrophotographic image forming apparatus and the optical scanning device therefor, which is substantially lower in cost than any combination of a conventionally structured electrophotographic image forming apparatus and the optical scanning device therefor.

Embodiment 2

Figure 10:
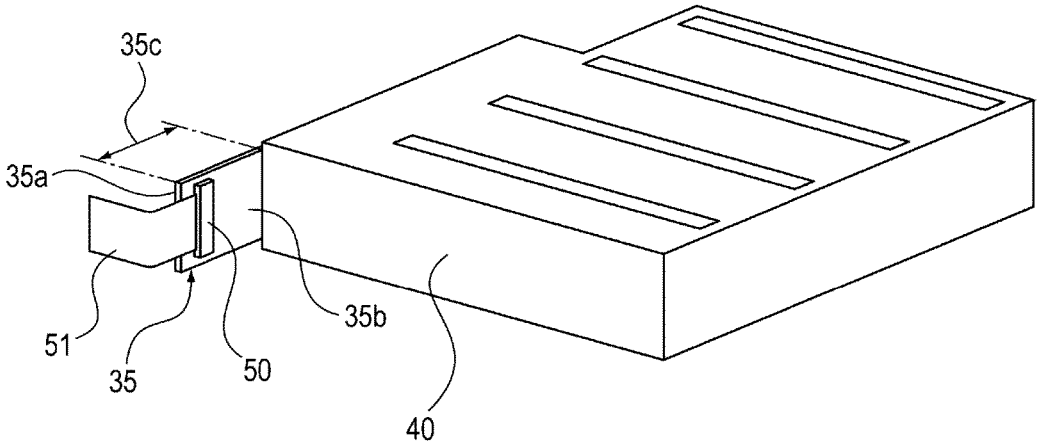
FIG. 10 is a perspective view of the optical scanning device 3 in the second embodiment. It is for showing the characteristic structural features of the device 3.

Next, referring to FIG. 10, the optical scanning device in the second embodiment of the present invention is described. FIG. 10 is a perspective view of the optical scanning device in the second embodiment.

In this embodiment, the laser driving circuit board 35 is made longer than that in the first embodiment so that the protrusive portion 35*a* extends beyond the optical box 40 in terms of the direction in which the optical scanning device 3 is inserted into the main assembly of the image forming apparatus 100. Otherwise, the image forming apparatus and optical scanning device in this embodiment are the same in function and the naming of their components as the counterparts in the first embodiment, and therefore, the portions of the image forming apparatus and optical scanning device in this embodiment other than the protrusive portion 35*a* are not described here. The second embodiment is different from the first embodiment only in that the optical scanning device in this embodiment is not provided with a small space for a finger, such as the one in the first embodiment, between the optical box 40 and the protrusive portion 35*a* of the optical scanning device 3.

This embodiment can provide another effect in addition to the one which the first embodiment can provide. That is, this embodiment makes it much easier for an operator to manually access the joint between the FFC 51 and connector 50, and therefore, makes it easier for an operator to insert the FFC 51 into the connector 50, or pull the FFC 51 out of the connector 50, than the first embodiment.

Further, this embodiment also makes it possible for an operator to visually check the joint between the FFC 51 and connector 50. Therefore, it can prevent the occurrence of such an operational error that the FFC 51 is inserted askew. Thus, it can ensure that the FFC 51 is properly inserted into, or pulled out of, the connector 50.

Moreover, this embodiment makes it unnecessary to eliminate a part of the optical box 40 to provide the above-described space. Therefore, it is superior to the first embodiment in that it is less restrictive in the positioning of various optical components in the optical box 40 than the first embodiment.

[Miscellanies]

By the way, in the preceding embodiments described above, the image forming apparatus and its optical scanning device were structured so that the photosensitive drums in the image forming portion were exposed from the underside of the image forming portion. However, the preceding embodiments are not intended to limit the present invention in scope. That is, the present invention is applicable to also an electrophotographic image forming apparatus structured so that its photosensitive drums are exposed by the optical scanning device from the topside of the image forming portion. The effects of such an application of the present invention are similar to those described above.

Further, in the preceding embodiments, the image forming apparatus and its optical scanning device were structured so that the optical scanning device was enabled to project a beam of laser light to all of the four image forming portions. However, the preceding embodiments are not intended to limit the present invention in the number of image forming portions of an electrophotographic image forming apparatus to which the present invention is to be applied. That is, the number of the image forming portions is optional.

Further, in the preceding embodiments, the image forming apparatus equipped with the optical scanning device was a printer. However, the preceding embodiments are not intended to limit the present invention in terms of the type of an electrophotographic image forming apparatus to which the present invention is applicable. That is, the present invention is also applicable to other image forming apparatus than printers. For example, the present invention is applicable to a copying machine, a facsimileing machine, etc., and also, a multifunction machine capable of functioning as two or more of the preceding image forming apparatuses. The application of the present invention to the optical scanning device which any of these image forming apparatuses has can provide the same effect as those described above.

According to the present invention, in order to provide a space for making it easier for an operator to disconnect or connect the FFC of the main assembly of an electrophotographic image forming apparatus when the operator is replacing the optical scanning device in the main assembly, the control circuit board of the optical scanning device is provided with a protrusive portion, and the connector of the optical scanning device, to which the FFC is to be inserted, is placed on the protrusive portion. Thus, an operator can easily replace the optical scanning device in a short length of time. Further, the provision of the above-described space makes it possible for an operator to visually check the joint between the FFC and connector. Therefore, it is possible to prevent an operator from making an operational error when the operator is replacing the optical scanning device. Further, the provision of the space makes unnecessary the components dedicated to the connection of the FFC. Thus, the present invention can reduce in cost a combination of an electrophotographic image forming apparatus and an optical scanning device therefor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-083508 filed on Apr. 19, 2016, which is hereby incorporated by reference herein in its entirety.

What is claimed is:

1. An optical scanning apparatus comprising:

a light source configured to emit a beam in accordance with image information;

a controller substrate configured to control said light source;

a deflector configured to scanningly deflect the beam emitted by said light source;

an optical system configured to direct the beam deflected by said deflector onto a member-to-be-scanned;

a casing supporting said controller substrate, said deflector and said optical system, wherein said controller substrate is provided with a projected portion projecting relative to said casing; and a connector configured to removably connect a cable for supplying a signal to said light source, said connector being provided on a surface of said projected portion where said controller substrate is supported by said casing, wherein said cable is insertable and removable relative to said connector in a direction parallel with the surface of said projected portion provided with said connector.

2. An apparatus according to claim 1, wherein a space is provided between said casing and the surface of said projected portion provided with said connector.

3. An apparatus according to claim 2, wherein a distance of projection of said projected portion relative to said casing is not less than 15 mm, and the space is not less than 20 mm.

4. An apparatus according to claim 1, wherein said connector is provided at an end portion of said projected portion where said projected portion is projected from said casing.

5. An apparatus according to claim 4, wherein said optical scanning apparatus is included in an image forming apparatus configured to form an image on a recording material, wherein said projected portion is projected toward an upstream side with respect to a direction of inserting said optical scanning apparatus into said image forming apparatus, and said connector is provided at an upstream side end portion of said projected portion with respect to the inserting direction.

6. An apparatus according to claim 1, wherein said optical scanning apparatus is included in an image forming apparatus configured to form an image on a recording material, said cable is insertable into and removable from said connector in the direction which is the direction in which said optical scanning apparatus is inserted into said image forming apparatus.

7. An image forming apparatus comprising an optical scanning apparatus according to claim 1, a structural member configured to removably supporting said optical scanning apparatus, and an outer cover openably provided on a predetermined side of said image forming apparatus to permit insertion and removal of said optical scanning apparatus relative to said structural member.

8. An apparatus according to claim 7, wherein said optical scanning apparatus is disposed below the member to be scanned by said optical scanning apparatus.

* * * * *